US008167377B2

(12) United States Patent
Kovach

(10) Patent No.: US 8,167,377 B2
(45) Date of Patent: May 1, 2012

(54) KNOCK-DOWN CHAIR WITH INTERMEDIATE SUPPORT AND COMPOUND LEG

(76) Inventor: John G. Kovach, Greenwich, CT (US)

( * ) Notice: Subject to any disclaimer, the term of this patent is extended or adjusted under 35 U.S.C. 154(b) by 0 days.

(21) Appl. No.: 12/736,602

(22) PCT Filed: Jul. 7, 2009

(86) PCT No.: PCT/US2009/003968

§ 371 (c)(1),
(2), (4) Date: Oct. 21, 2010

(87) PCT Pub. No.: WO2010/019181

PCT Pub. Date: Feb. 18, 2010

(65) Prior Publication Data

US 2011/0031798 A1 Feb. 10, 2011

(51) Int. Cl.
*A47C 7/00* (2006.01)

(52) U.S. Cl. ..... 297/440.13

(58) Field of Classification Search ..... 297/440.13, 297/440.1, 440.15, 440.2, 440.22
See application file for complete search history.

(56) References Cited

U.S. PATENT DOCUMENTS

| | | | | | |
|---|---|---|---|---|---|
| 521,395 | A | * | 6/1894 | Van Norman | 297/440.13 |
| 565,435 | A | * | 8/1896 | Crater | 108/157.1 |
| 1,257,389 | A | * | 2/1918 | Platt | 446/396 |
| 2,490,884 | A | * | 12/1949 | Rau | 297/440.15 |
| 2,792,877 | A | * | 5/1957 | West, Jr. | 297/440.13 |
| 3,547,491 | A | * | 12/1970 | Bovasso | 297/440.13 |
| 4,183,154 | A | * | 1/1980 | Dykes | 434/167 |
| 4,313,276 | A | * | 2/1982 | Fleming | 446/86 |
| 5,275,467 | A | * | 1/1994 | Kawecki | 297/440.13 |

* cited by examiner

*Primary Examiner* — Milton Nelson, Jr.
(74) *Attorney, Agent, or Firm* — Ohlandt, Greeley, Ruggiero & Perle, L.L.P.

(57) ABSTRACT

An intermediate support structure provides a device whereby individual members of a furniture item can be assembled into an optimized configuration. The use of the intermediate structure allows the individual members of the furniture item to be assembled to achieve maximum structural benefit from their arrangement.

7 Claims, 7 Drawing Sheets

KNOCK-DOWN CHAIR WITH INTERMEDIATE SUPPORT AND COMPOUND LEG

DETAILED DESCRIPTION

Figure 1:
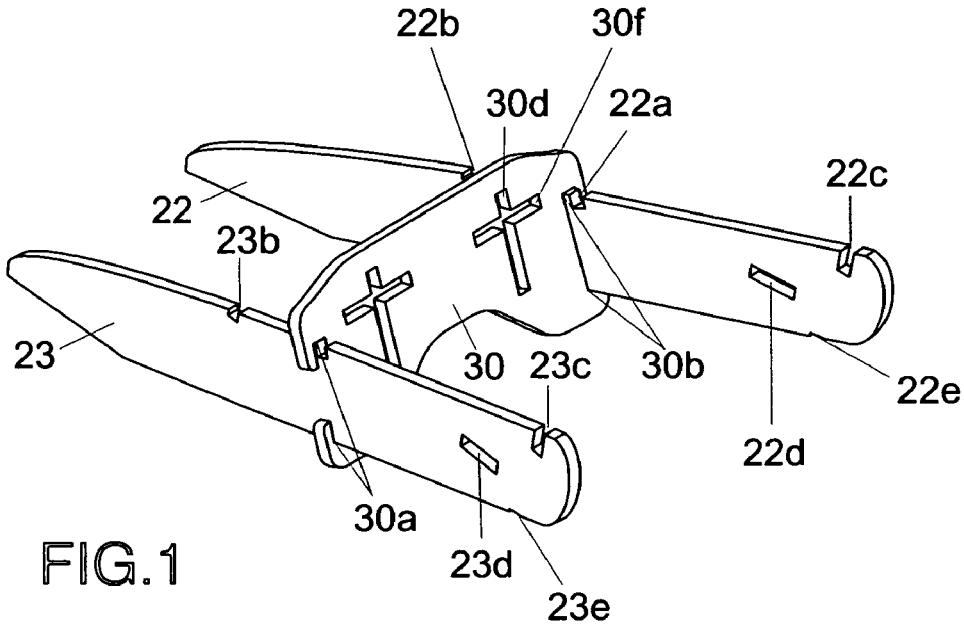
FIG. 1 is a left front perspective view of the partial assembly.

FIG. 1 is a left front perspective view showing an arrangement of the center bridge 30 and the rail sides 22, 23. The center bridge 30 is fitted with channel like cutouts 30*b*, 30*a* on either side. The two rails sides 22, 23 have been inserted into these openings forming a partial assembly. The vertical parallel slots 30*d*, (30*c* FIG. 2) in the middle of the center bridge 30 are for receiving the back supports (24, 25 FIG. 3). The horizontal cutouts 30*f*, (30*e* FIG. 2) align with the top edges of the rail sides. These openings will accommodate the tabs of the seat (36 FIG. 8). The rail sides are provisioned with a number of notches and cutouts for receiving other members of the chair. Notches 22*a*, (23*a* FIG. 2) establish the position of the back (35 FIG. 7}, notches 22*b*, 23*b* engage with the rear brace (32 FIG. 4). The notches at the front of the rail sides 22*c*, 23*c* hold the front cross bar (34 FIG. 7). The cutouts 22*d*, 23*d* are for receiving the ends of the front spreader (31 FIG. 2). Mount points 22*e*, 23*e* are where the rail sides contact the leg faces (28, 29 FIG. 6).

Figure 2:
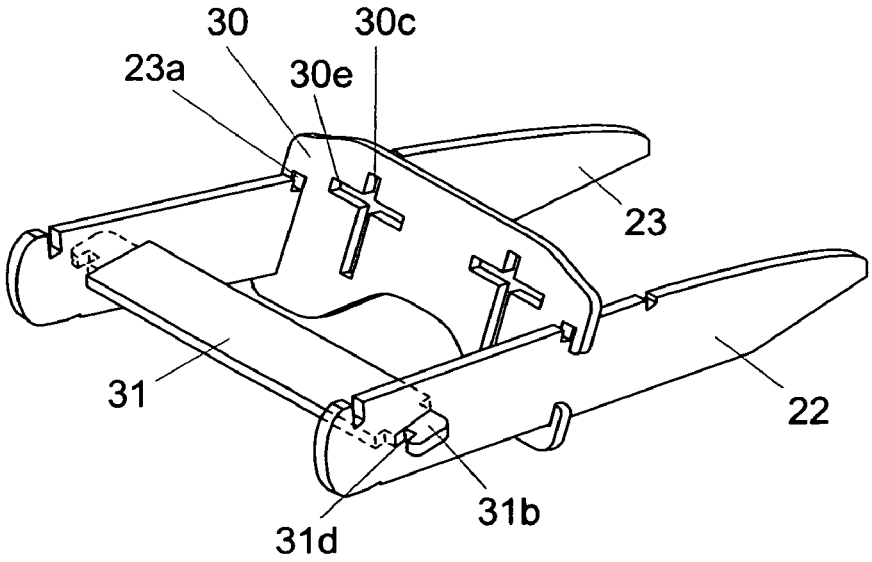
FIG. 2 is a right front perspective view of the partial assembly with the front spreader 31 in place.

FIG. 2 is a right front perspective view of the partial assembly. The ends of the front spreader 31*b*, (31*a* FIG. 3) are inserted through the cutouts (22*d*, 23*d* FIG. 1) of the rail sides.

The shoulders at the ends of the front spreader contact the inner walls of the rail sides 22, 23 and keep them place at a fixed distance.

Figure 3:
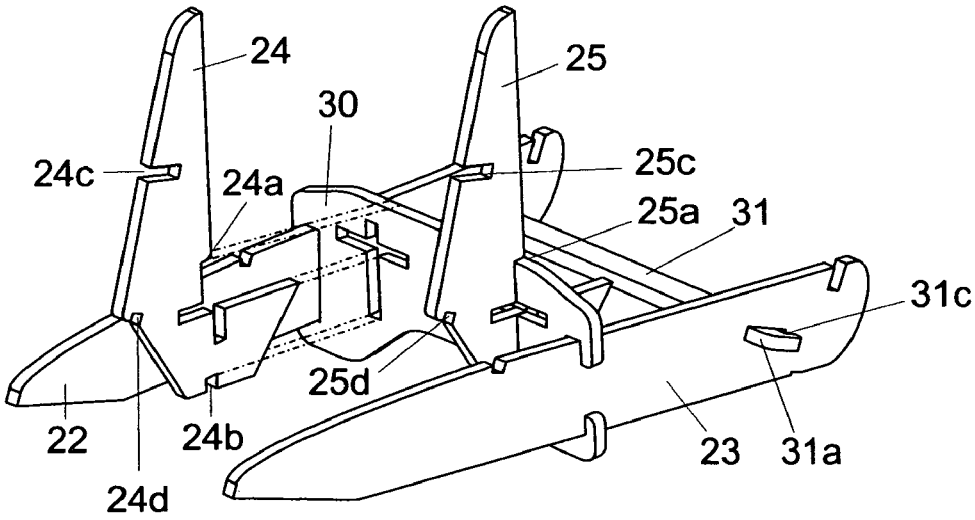
FIG. 3 is a left back perspective view of the partial assembly showing back support 25 in place. The back support 24 is shown in exploded view.

FIG. 3 is a left back perspective view of the partial assembly. The back support 25 is shown fully engaged in the center bridge 30. The back support 24 passes through the vertical slot (30*d* FIG. 1) in the center bridge. Notch 24*b* engages the center bridge 30 and the recessed cutouts 24*a*, 25*a* rest on the top edge.

Figure 4:
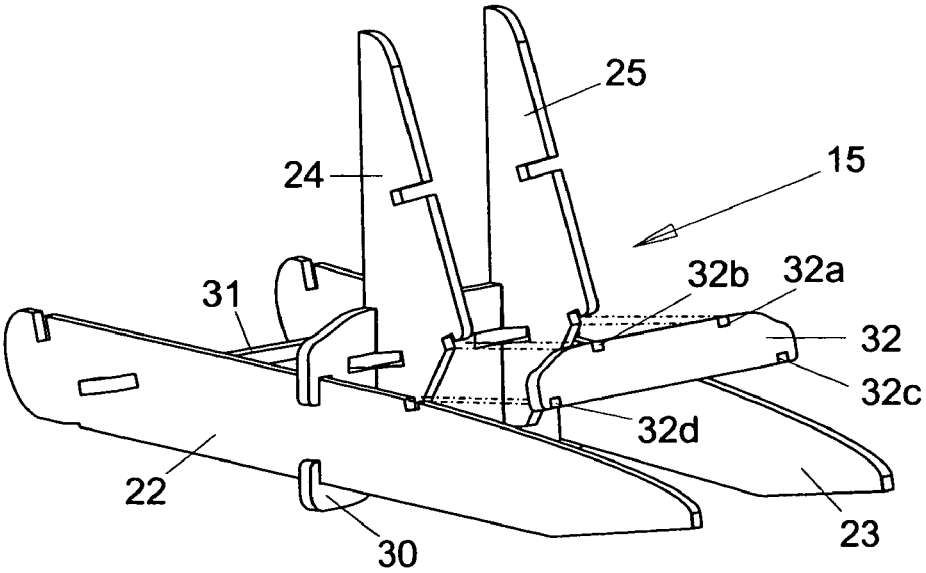
FIG. 4 is a right back perspective view of the partial assembly. The back supports 24, 25, and the center bridge 30 are shown tipped forward and the rear brace 32 is shown in exploded view.

FIG. 4 is a right back perspective view of the partial assembly. The back supports 24, 25 along with the center bridge 30 have been tipped forward. The rear brace 32 is provisioned with notches 30*b*, 30*a* that fit into notches (24*d*, 25*d* FIG. 3) on the bottom of the back supports. The back supports 24, 25, the center bridge 30, and the rear brace 31, together make up the intermediate support structure 15. When the intermediate support structure is tilted back notches 32*d*, 32*c* on the bottom of the rear brace fit into the notches (22*b*, 23*b* FIG. 1) on top of the rail sides.

Figure 5:
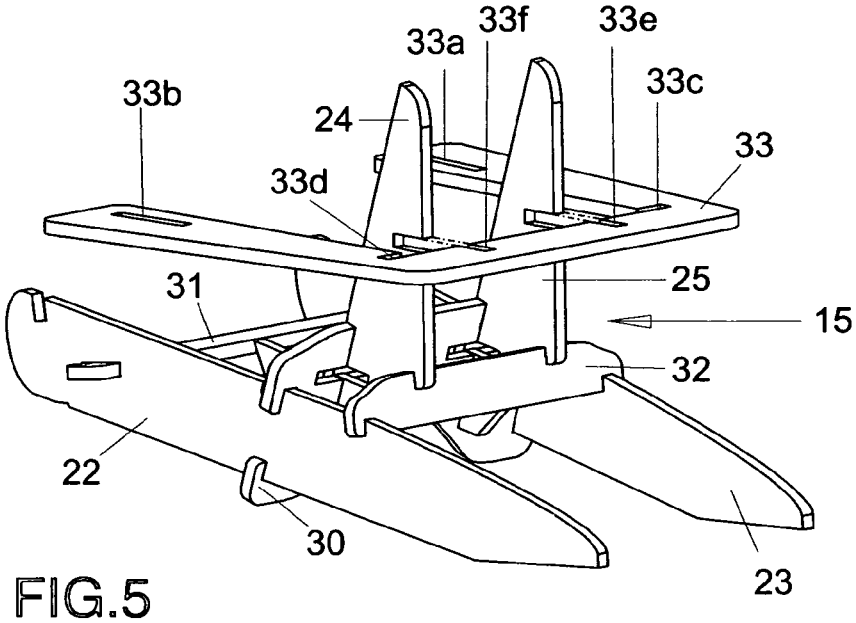
FIG. 5 is a back right perspective view of the partial assembly showing the intermediate support structure 15 in position. The arms 33 are shown in exploded view.

FIG. 5 is a back right perspective view of the partial assembly. The intermediate support structure 15 is shown in its working positions on top of the side rails. The rear brace 32 is fully engaged with the rail side 22, 23. Slots 33*f*, 33*e* in the arms fit into corresponding slots (24*c*, 25*c* FIG. 1) in the back supports.

Figure 6:
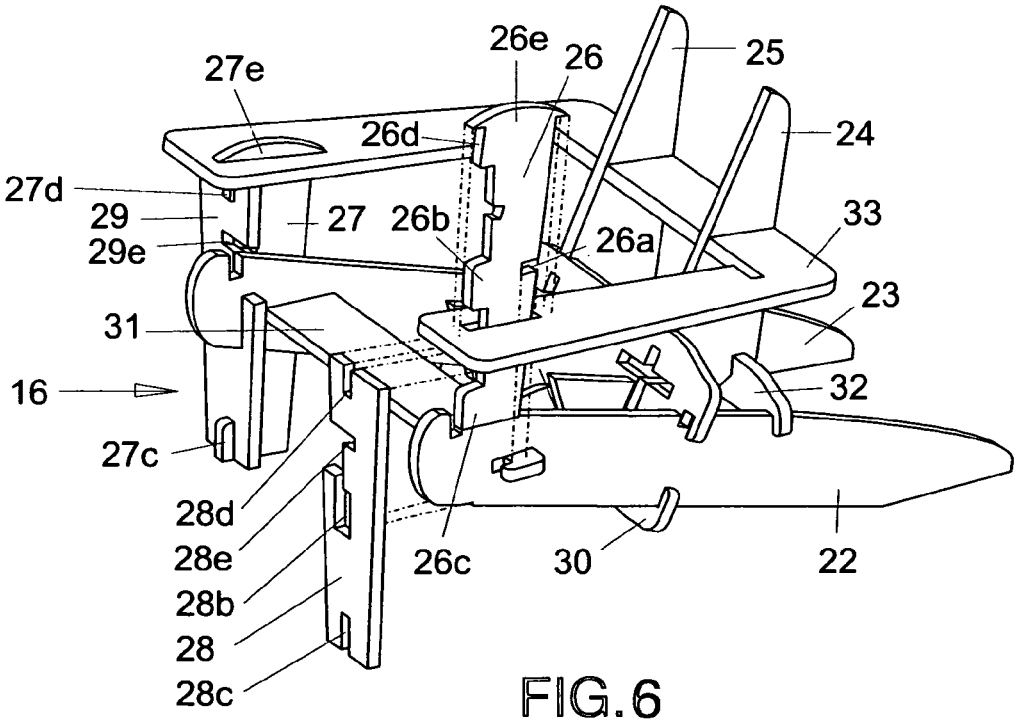
FIG. 6 is a right front perspective view of the partial assembly. The leg side left 27 and the leg face left 29 are shown in place. The leg side right 26 and leg face right 28 are shown in exploded view.

FIG. 6 is a right front perspective view of the partial assembly showing the leg side 27 and the leg face 29 in place. The leg side 26 passes through a slot (33*b* FIG. 5) in the arms. The head of the leg side 26*e* acts as a stop. A notch on the back edge 26*a* fits into a corresponding notch (31*b* FIG. 3) on the front spreader. The leg sides press against the rail sides holds them against the shoulders of the front spreader 31. When joined together the leg side and the leg face become the compound leg 16.

Figure 7:
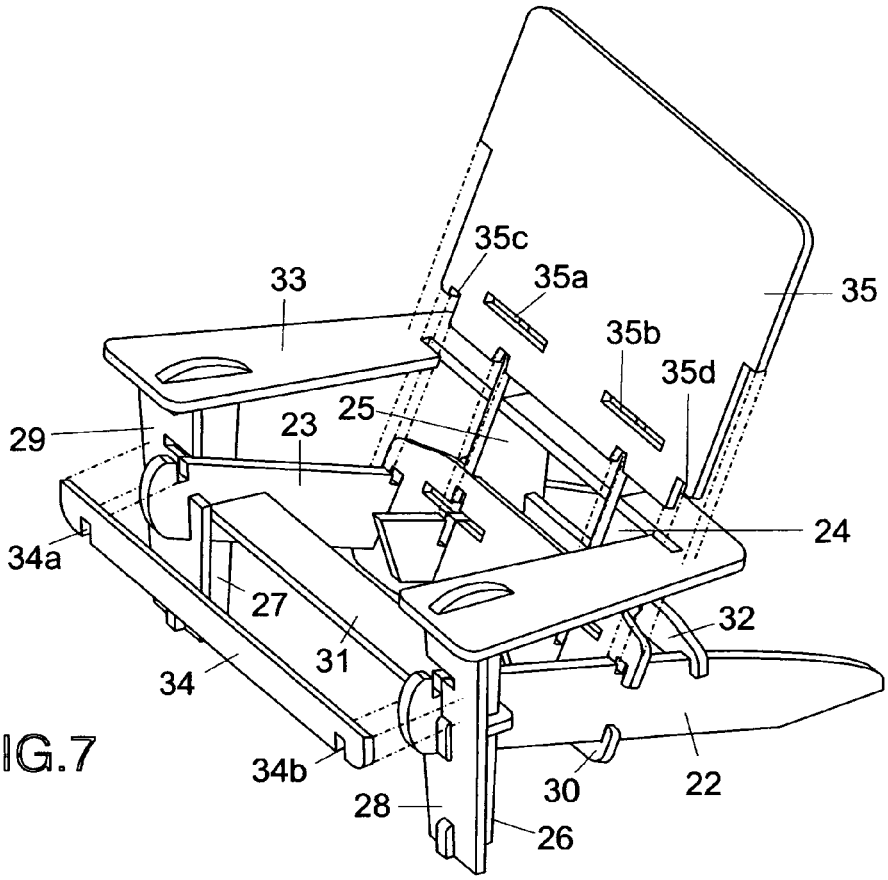
FIG. 7 is an isometric view of the partial assembly. The back 35 and front cross bar 34 are shown in exploded view.

FIG. 7 is an isometric view of the partial assembly. The back 35 fits through slots at the inner rear corners of the arms (33*c*, 33*d* FIG. 5). The back 35 sits against the front edges of the back supports 24, 25 and locks the arms 33 in place. When fully in place the bottom of the back spans the side rails 22, 23 and the openings in the back 35*a*, 35*b*, and the openings in the center bridge (30*e* FIG. 2), (30*f* FIG. 1) are aligned. Notches 34*b*, 34*a* in the front cross bar 34 fits into the corresponding notches (22*c*, 23*c* FIG. 1) at the front of the rail sides.

Figure 8:
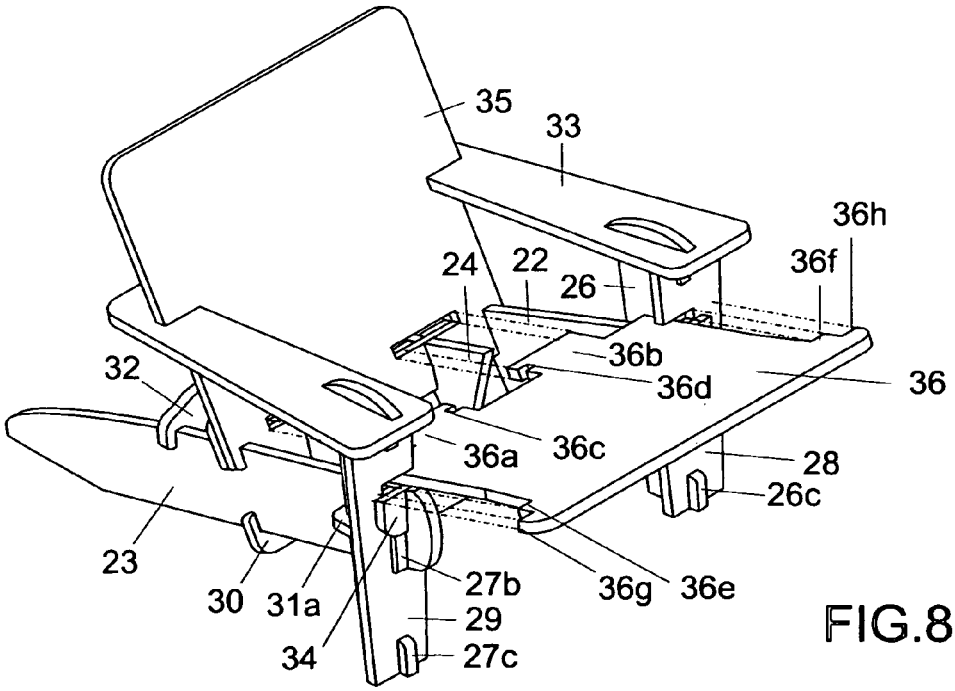
FIG. 8 is a left front perspective view of the partial assembly with an exploded view of the seat 36.

FIG. 8 is a right front perspective view of the partial assembly. The seat 36, slides through the cut outs in the leg faces (28*e*, 29*e* FIG. 6) and sits on top of the rail sides 22,23. Tabs at the inside front corners of the seat 36*f*, 36*e* fit through the cut outs formed at the junction of the legs faces 28, 29 and the leg sides 26, 27. The lips 36*h*, 36*f* of the seat contacts the leg faces 28, 29.

Figure 9:
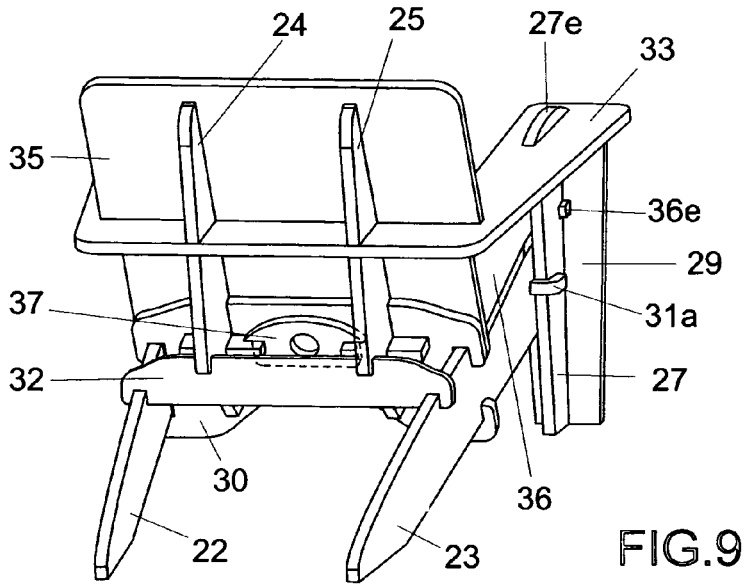
FIG. 9 is a back left perspective view of the final assembly showing the lock 37 in place.

FIG. 9 is a back left perspective view of the final assembly. A locking member 37 is fitted into the notches on the tabs of the seat (36*c*, 36*d* FIG. 8) that emerge at the back of the center bridge 30.

Figure 10:
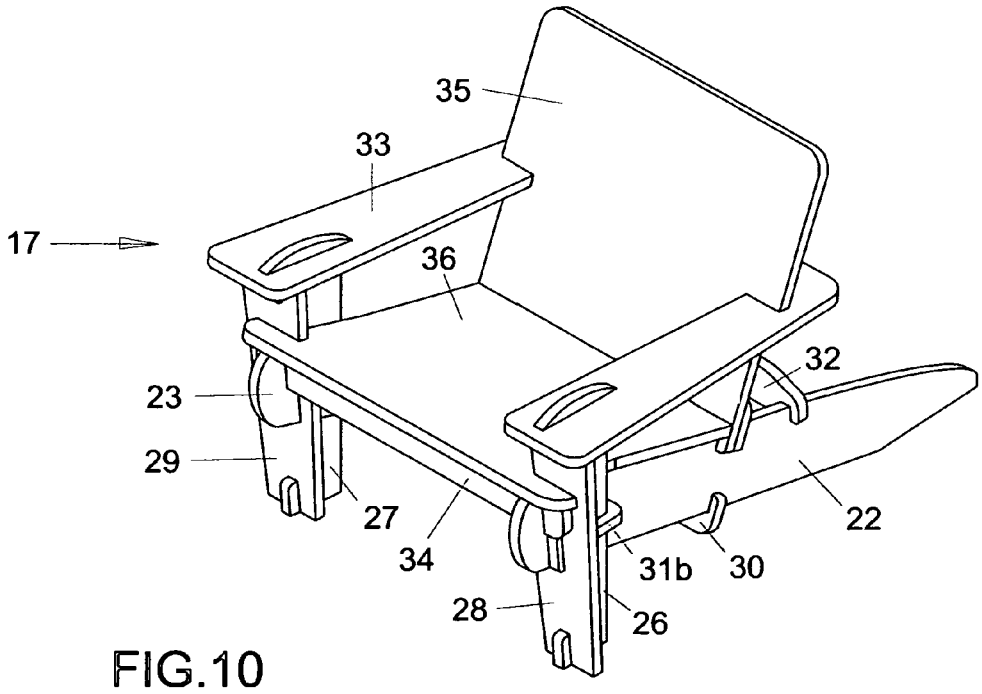
FIG. 10 is an isometric view of the completed chair 17

FIG. 10 is an isometric view of the assembled chair 17.

Operation of the Preferred Embodiment

The chair is intended to be a primary seating structure, which can be easily assembled or disassembled with out any special tools or skills. Assembly begins by passing the two rail sides 22, 23 through the outer openings 30*b*, 30*a* of the center bridge 30. The ends of the front spreader 31 are inserted through the cut outs 22*d*, 23*d* at the front of the rail sides. The back supports 24, 25 are then inserted into the vertical slots 30*d*, 30*c* in the center bridge 30. The subassembly 30, 24, and 25 is tipped forward to allow the rear brace 32 to be inserted.

30, 24, 25, and 32 comprise the intermediate support structure 15. The entire intermediate support is tilted back until it engages with the rail sides. The arms 33 are attached by sliding them into the slots 24*c*, 25*c* at rear of the back supports. The leg sides 27, 29 are then slid through the openings 33*b*, 33*a* at the front of arms 33. A notch on the back of the leg side 26*a* fits into a corresponding notch 31*d* on the front spreader 31, this holds the rail side 22 against the shoulders of the front spreader. Next the leg faces 28, 29 are fitted to the chair. Openings in the leg face 28*b*, 28*c*, and 28*d* match the protruding tabs 26*b*, 26*c*, and 26*d* of the leg sides. The leg faces 28, 29 are installed by pushing them straight back until they contact the front edge of the leg sides 26, 27. A small extension on the inside of the leg face holds the rail side and the leg side together. Installation of the leg faces 36, 27 also pushes the arms 33 upwards and holds them in place against the head of the leg sides 25*e*, 27*e*. The front cross bar 34 is fitted into the notches 22*c*, 23*c* at the front of the rail sides. The back 35 is installed by sliding it through the cut outs 33*d*, 33*c* at the back inner corners of the arms 33. When fully in place the bottom of the back 35 spans the rail side and the openings of the back 35*a*, 35*b* are aligned with those of the center bridge 30*e*, 30*f*. The small notches on the bottom of the back 35 keep the rail sides and the back supports aligned. The seat 36 is installed by sliding it through the slots 28*e*, 29*e* of the leg faces 28, 29. The tabs 36*a*, 36*b* at the rear of the seat 36 pass through the cutouts 35*a*, 35*b* in back and extend through the horizontal slots 30*e*, 30*f* of the center bridge 30. Small protrusions 36*g*, 36*h* on the inside front corners of the seat 36 fit into the openings at the junctions of the leg sides and the leg faces. When the seat 36 is fully in place the notches 36*c*, 36*d* on the tabs 36*a*, 36*b* at the rear of the seat emerge at the back of the center bridge 30.

A lock member 37 is inserted into these openings. 36*c*, 36*d* and prevents the seat 36 from being withdrawn. Once the lock is in place the chair is quite stable and can be used the same way as a conventional piece of furniture.

Disassembly of the chair is accomplished by removing the parts in reverse order.

The rail sides shown in this embodiment are straight. This is because the chair was made for an Adirondack Chair design competition.

Future embodiments contemplate articulating the rail sides so that the chair would have a more conventional appearance. Although this application depicts an Adirondack style chair it is not limited to any particular design or style.

Description Additional Embodiment 1

Figure 11:
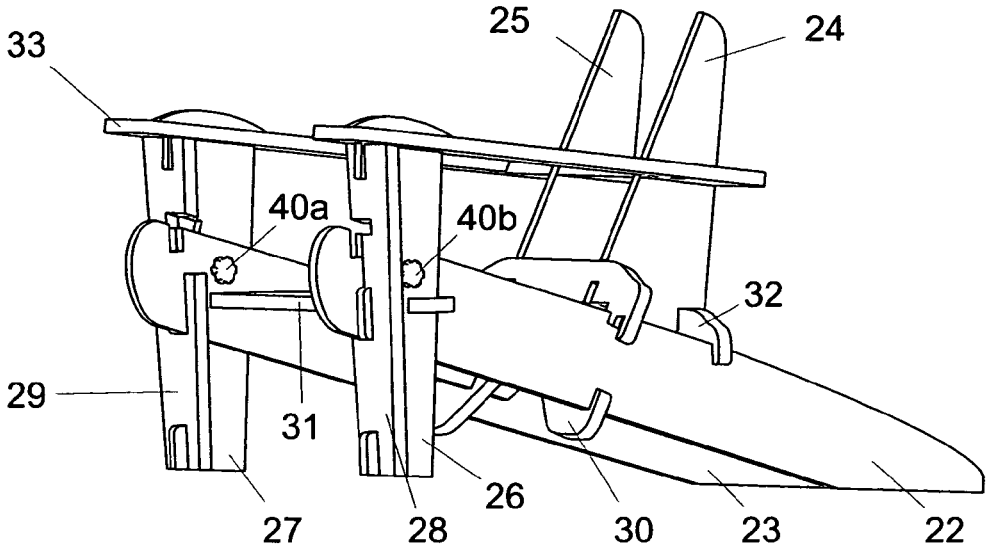
FIG. 11 is a right front perspective view of additional embodiment 1. This is variation of the preferred embodiment with the addition of fasteners.

FIG. 11 is a right front perspective view of additional embodiment 1. This is embodiment is essentially the same as the preferred embodiment with the addition of fasteners 40*a*, 40*b*.

Figure 12:
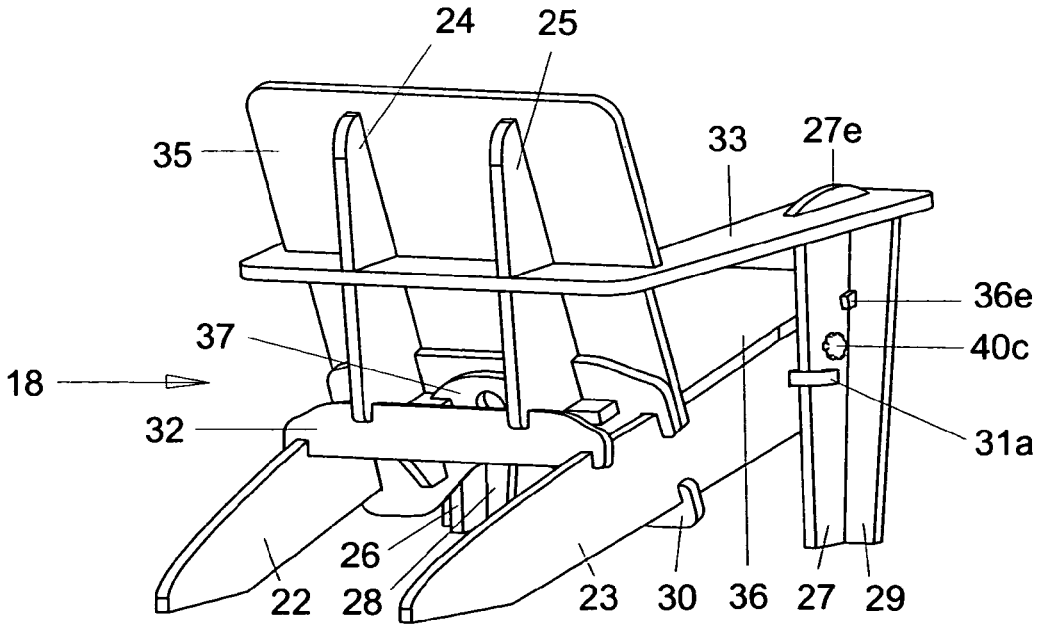
FIG. 12 is a back left perspective view of additional embodiment 1. It depicts the completed chair 18

FIG. 12 is a back left perspective view of additional embodiment 1. It depicts the completed chair 18. The outer knob 40*c* of the fastener is shown where it extends through the rail side 23.

Operation Additional Embodiment 1

The operation of this embodiment is the identical to that of the preferred embodiment with the added step of using mechanical fasteners to secure the rail sides and the leg sides together. After the leg sides 26, 27 are fitted into the partial assembly, fasteners 40*b*, 40*a* are inserted through holes that run through the side rail and the leg side and then tightened. The use of a mechanical fastener may provide a more positive way of securing the leg sides to the rail sides but it distracts from the design and is an extra part that may be unnecessary.

Description Additional Embodiment 2

Figure 13:
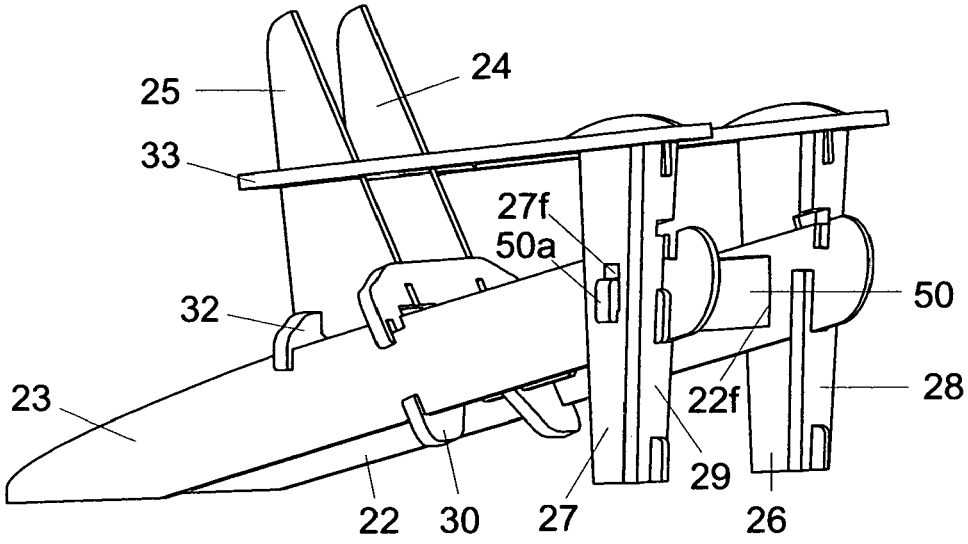
FIG. 13 is a left front perspective view of additional embodiment 2. It depicts a partial assembly. The front spreader is shown with a vertical orientation.

FIG. 13 is a left front perspective view of additional embodiment 2. In this embodiment the orientation of the front spreader 50 is changed from horizontal to vertical. The cut outs in the leg sides 26, 27 and rail sides 22, 23 are also changed to horizontal.

Figure 14:
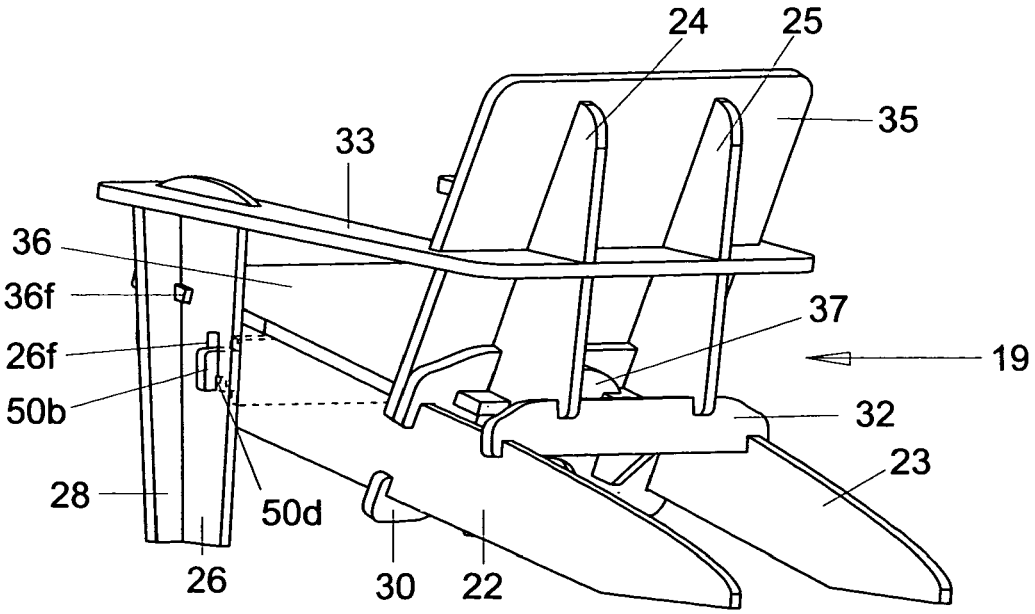
FIG. 14 is a back right perspective view of additional embodiment 2. It depicts the completed chair 19

FIG. 14 is a back right perspective view of additional embodiment 2. It depicts the completed chair 19. The end 50*b* of the vertical front spreader 50 is shown where it passes through the vertical cutout 26*f* and engages the leg side 26.

Operation Additional Embodiment 2

The operation of this embodiment is similar to that of the preferred embodiment. The main difference comes in attaching the leg sides to the front spreader. During assembly the leg sides 26, 27 are only partially inserted into the arms 33. The arms along with the intermediate support structure are tilted forward and the leg sides maneuvered onto the ends of the front spreader 50*a*, 50*b*. The arms 33 and the intermediate support structure 15 can be worked back into place and the leg sides can be slid up. The notches on the bottom ends of the front spreader grasp the leg sides. This is an imperfect design however the vertical front spreader offers more strength. This chair may be possible to build by adjusting the taper of the rail sides and making other modifications.

The invention claimed is:

1. A knock-down chair comprising:

an intermediate support structure comprising a first plurality of separate members that comprises a center bridge, a rear brace, a first back support and a second back support;

a second plurality of separate members comprising a first rail, a second rail, an arm structure, a seat, a back, a first leg and a second leg;

a plurality of interlocking contact points disposed on said first plurality of separate members and said second plurality of separate members;

wherein, when said first plurality of separate members is assembled with said first and second rails, said center bridge and said rear brace are disposed between and interlocked to said first and second rails, and said first and second back supports are disposed to and interlocked with said center bridge and said rear brace so as to provide said intermediate support structure with structural rigidity; and wherein, when said intermediate support structure is further assembled with a remainder of said second plurality of separate members, said arm structure interlocks with said first and second back supports, said back interlocks with said center bridge and said first and second back supports, and said first and second legs interlock with said first and second arms and first and second rails, respectively.

2. The knock-down chair of claim 1, wherein said knock-down chair is assembled with said interlocking contact points without any mechanical fasteners.

3. The knock-down chair of claim 1, wherein said first plurality of separate members further comprises a front spreader, wherein said plurality of interlocking contact points further comprises interlocking contact points on said front spreader, such that, when assembled, said front spreader is disposed between and interlocked with said first and second rails.

4. The knock-down chair of claim 3, wherein said front spreader is further interlocked with said first and second legs when assembled.

5. The knock-down chair of claim 4, wherein said first plurality of separate members and said second plurality of separate members have structures that, when disassembled, can be readily arranged in a compact condition for convenient storage or shipping.

6. The knock-down chair of claim 4, wherein said each of said first and second legs comprises: a first leg side and a second leg side that when assembled are at a right angle to one another with said first leg interlocked with said arm structure and said front spreader and with said second leg side interlocked to said first leg side, said front spreader, and one of said first and second rails.

7. The knock-down chair of claim 6, where a load applied to an interlocking contact point of one of said first and second leg sides is effectively transferred to the other of said first and second leg sides, and wherein said first and second leg sides strengthen and stabilize one another.

* * * * *